US005770118A

United States Patent [19]

Lee

[11] Patent Number: 5,770,118

[45] Date of Patent: Jun. 23, 1998

[54] BUBBLE GENERATOR FOR A WASHING MACHINE

[75] Inventor: Jea-Yoll Lee, Kyunggi-Do, Rep. of Korea

[73] Assignee: Daewoo Electronics Co., Ltd., Seoul, Rep. of Korea

[21] Appl. No.: 752,744

[22] Filed: Nov. 21, 1996

[30] Foreign Application Priority Data

Nov. 22, 1995 [KR] Rep. of Korea ..... 1995-34729

[51] Int. Cl.[6] ..... B01F 3/04

[52] U.S. Cl. ..... 261/30; 417/473

[58] Field of Search ..... 261/30; 417/473, 417/412, 413.1

[56] References Cited

U.S. PATENT DOCUMENTS

| | | | |
|---|---|---|---|
| 77,003 | 4/1868 | Crawford | 417/473 |
| 1,380,442 | 6/1921 | Trumble | 417/413.1 |
| 3,136,616 | 6/1964 | Thompson | 417/473 |
| 3,247,804 | 4/1966 | Behan et al. | 417/413.1 |
| 4,047,851 | 9/1977 | Bender | 417/412 |
| 4,718,836 | 1/1988 | Pottier et al. | 417/473 |
| 5,253,380 | 10/1993 | Lim et al. | 68/183 |
| 5,295,373 | 3/1994 | Lim et al. | 68/12.05 |
| 5,307,649 | 5/1994 | Lim et al. | 68/12.05 |
| 5,588,811 | 12/1996 | Price | 417/412 |

FOREIGN PATENT DOCUMENTS 0 495 168 A1 7/1992 European Pat. Off. .

*Primary Examiner*—Tim R. Miles

*Attorney, Agent, or Firm*—Beveridge, DeGrandi, Weilacher & Young LLP

[57] ABSTRACT

A bubble generator for a washing machine which utilizes bellows and an actuating cam for actuating the bellows is disclosed. The bubble generator includes a housing and a body installed within the housing. The body includes inlets for inflow of air at one side thereof, outlets for outflow of air at the other side thereof and passages for communicating the inlets with the outlets. Partitions for closing said passages are formed on the way of the passages, and spaces for expanding compressed air are formed adjacent to the outlets. An opposite pair of bellows are provided on an inner wall of the body. A plurality of holes are formed at the inner wall, one half of holes being for inflow of air into the pair of bellows, the other half of holes being for outflow of air out of the pair of bellows. An actuating cam for vibrating the pair of bellows by rotation is provided between the pair of bellows.

8 Claims, 3 Drawing Sheets

BUBBLE GENERATOR FOR A WASHING MACHINE

BACKGROUND OF THE INVENTION

1. Field of the Invention

The present invention relates to a washing machine, and more particularly to a bubble generator for an air bubble washing machine.

2. Description of the Prior Art

A washing machine has been developed which is designed to supply a predetermined amount of air bubbles into a washing tub so that laundry articles therein are cleaned with a higher degree of detergency for a shortened period of washing time. A washing machine with a bubble generator and a method of laundering with use of air bubbles are disclosed in U.S. Pat. Nos. 5,253,380, 5,295,373 and 5,307,649 to Lim et al.

FIGS. 1 and 2 show a conventional bubble generator used in an air bubble washing machine, FIG. 1 showing a sectional view of the conventional bubble generator and FIG. 2 showing a sectional view taken along A—A line shown in FIG. 1. Within a rectangular housing 10, solenoids 12 and magnets 14 adjacent to solenoids 12 are disposed. Actuating plates 16 extend along a longitudinal direction within housing 10, and magnets 14 are fixed to each end of actuating plates 16. A pair of bellows 18 are attached at the center of actuating plates 16. Outer peripheral edges of a pair of bellows 18 are attached to a body 24 having an inlet 20 at one side thereof and outlets 22 at the other side thereof. Inlet 20 is communicated with outlets 22 through passages 26. When solenoids 12 are energized, magnets 14 adjacent to solenoids 12 are vibrated. Then, actuating plates 16 are vibrated, so that a pair of bellows 18 are contracted and inflated in turn. Air flows in through inlet 20 by the expansion of a pair of bellows 18. Thereafter compressed air by the contraction thereof is expanded in spaces 30 after passing through holes 28 and flows out through outlets 22.

When the conventional bubble generator has been used for a long time, actuating plates 16 will become deformed to decrease a force for contracting a pair of bellows 18. This leads to insufficient supply of air bubbles into a washing tub and hence to a lowered laundering performance.

SUMMARY OF THE INVENTION

The present invention is devised to solve the foregoing problem. It is an object of the present invention to provide a bubble generator for an air bubble washing machine capable of being used for a long time without a lowering of performance.

In order to accomplish the above object of the present invention, there is provided a bubble generator comprising:

a housing;

a body including an inner wall and an outer wall, having inlets for inflow of air at one side thereof and outlets for outflow of air at the other side thereof, having passages for communicating the inlets with the outlets, the passages being defined by the inner and outer walls, having partitions for closing the passages, the partitions being formed adjacent to the inlets on the way of the passages, having spaces for expanding compressed air, the spaces being formed adjacent to the outlets, and having opposite pairs of holes formed at the inner wall, each pair of holes thereof being positioned so that portion of the inner wall at which one of the partitions is provided intervenes therebetween, the body being installed within the housing to expose the outlets out of the housing;

a pair of bellows provided opposite to each other on the inner wall of the body;

an actuating cam for vibrating the pair of bellows by rotation provided between the pair of bellows, the actuating cam having a width shorter than a distance between the pair of bellows and a length longer than the distance therebetween;

driving means for rotating the actuating cam; and elastic blocking means for intermittently closing a hole of each pair of holes provided adjacent to the inlets in response to pressure change within the passages.

The elastic blocking means is deformed to open the hole closed by the elastic blocking means if the pair of bellows are inflated, while the elastic blocking means is restored to their original shape to close the hole if the pair of bellows are contracted.

The pair of bellows are airtightly attached on the inner wall to surround the hole pairs and the blocking means.

BRIEF DESCRIPTION OF THE DRAWINGS

The above object and other advantages of the present invention will become more apparent by describing in detail preferred embodiment thereof with reference to the attached drawings in which.

DETAILED DESCRIPTION OF THE PREFERRED EMBODIMENT

Figure 1:
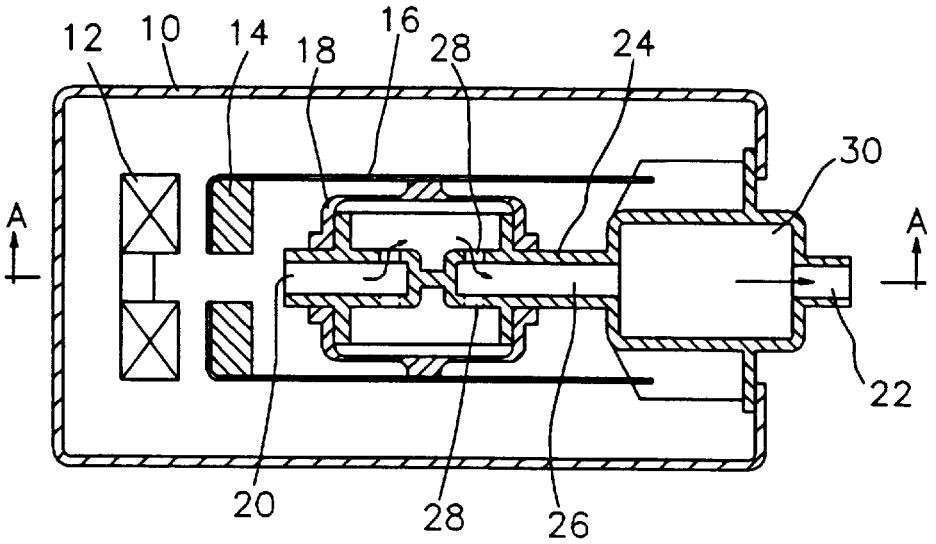
FIG. 1 PRIOR ART
FIG. 1 is a sectional view of a conventional bubble generator.
Figure 2:
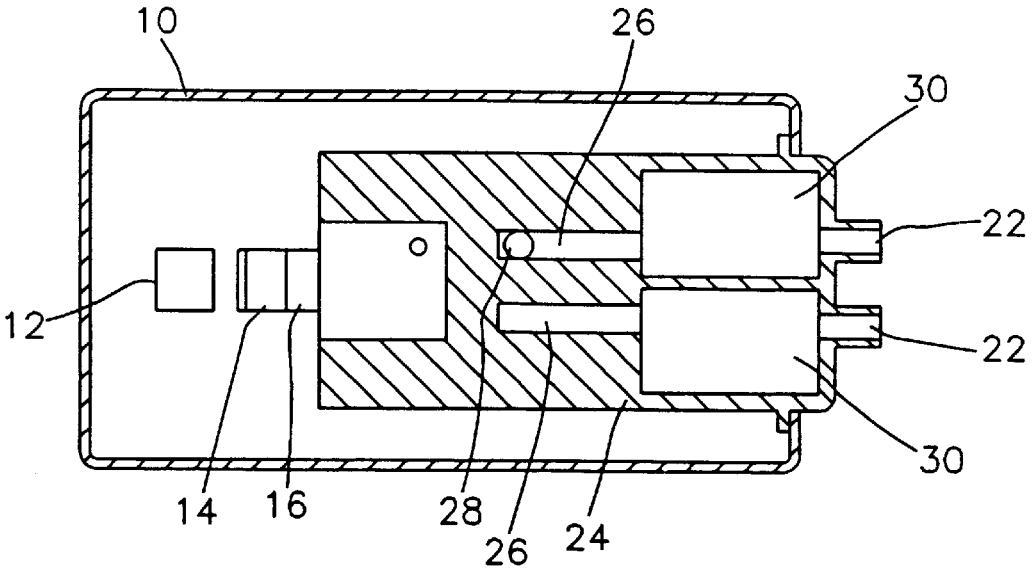
FIG. 2 PRIOR ART
FIG. 2 is a sectional view taken along A—A line shown in FIG. 1.
Figure 3:
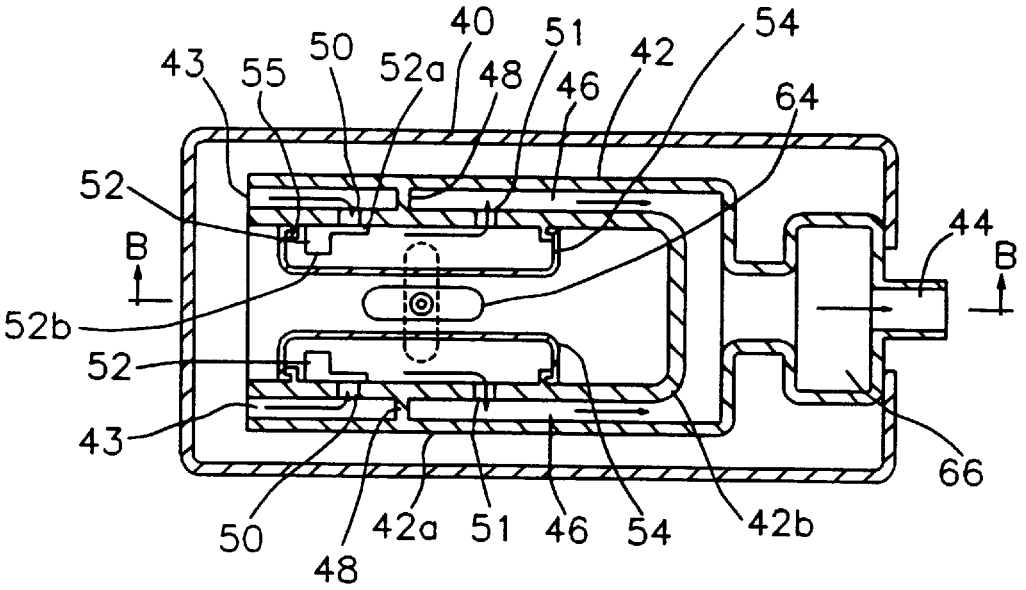
FIG. 3 is a sectional view according to the present invention.
Figure 4:
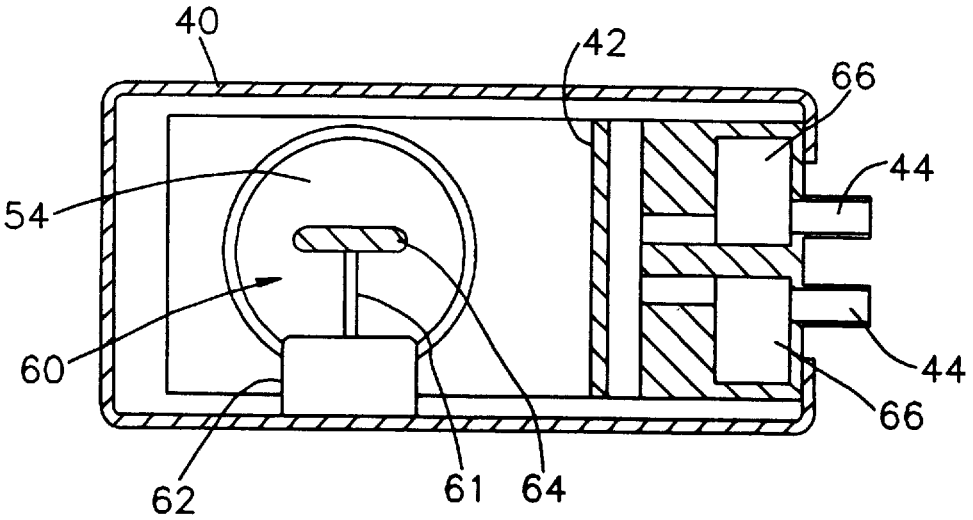
FIG. 4 is a sectional view taken along B—B line shown in FIG. 3.
Figure 5:
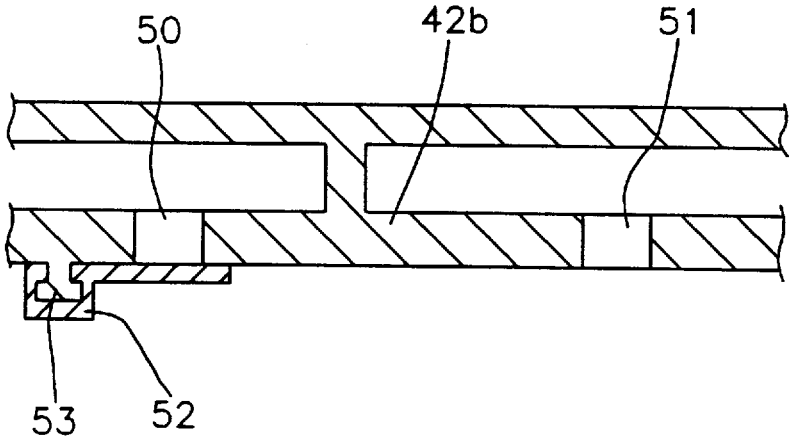
FIG. 5 is a partially sectional view showing the coupling relationship between a blocking element and an inner wall of a body.

The preferred embodiment of a bubble generator according to the present invention will be described in detail with reference to FIGS. 3 to 5.

A bubble generator includes a rectangular housing 40 and a body 42 disposed within housing 40. A portion of body 42 is exposed to the outside of housing 40, passing through housing 40.

At the longitudinal opposite sides of body 42, inlets 43 through which air flows into body 42 and outlets 44 through which air flows out of body 42 are formed. Passages 46 for communicating inlets 43 with outlets 44 are formed at body 42. Preferably, body 42 has a symmetric structure along B—B line, and passages 46 are provided at the opposite sides of body 42. Body 42 is formed of an outer wall 42*a* and an inner wall 42*b*, between which passages 46 are defined. Passages 46 are closed by partitions 48 provided adjacent to inlets 43 on the way of passages 46, and pairs of holes 50 and 51 are formed at inner wall 42*b* of body 42. As a result, inlets 43 are communicated with outlets 44 not directly, but through pairs of holes 50 and 51 as shown by the directions of the arrows in FIG. 3.

In order to interrupt air flow passing through holes 50 adjacent to inlets 43, blocking elements 52 are installed on inner wall 42*b*. Blocking elements 52 are made of elastic materials, such as rubber, having the self-restoring capacity. Each of blocking elements 52 has an elastic plate 52*a* and a fixed portion 52*b* for fixedly mounting blocking elements 52 on inner wall 42*b*. As shown in FIG. 5, T-shaped protrusions 53 are formed on inner wall 42*b* of body 42 so that blocking elements 52 are fixedly mounted on inner wall 42*b* by engaging T-shaped protrusions 53 with fixed portion 52*b* of blocking elements 52.

A pair of bellows 54 are opposingly installed on inner wall 42*b* of body 42. Preferably, each of the pair of bellows 54 has a circular sectional shape and is mounted on inner wall 42*b* by engaging an outer peripheral edge portion of bellows 54 with a L-shaped protrusion 55 formed on inner wall 42*b* to surround holes 50 and 51 and blocking element 52. Preferably, L-shaped protrusion 55 has a circular shape. Bellows 54 are made of elastic materials, such as rubber, having the self-restoring capacity. Air flowing in through inlets 43 is introduced through holes 50 into spaces defined by a pair of bellows 54 and inner wall 42*b* of body 42. Air compressed within a pair of bellows 54 is directed to outlets 44, passing through holes 51 and passages 46.

A bellows driving part 60 is provided between an opposite pair of bellows 54. Bellows driving part 60 is installed on an inner wall of housing 40 and comprises a motor 62 having a rotating shaft 61 and an actuating cam 64 fixedly mounted to an outer end of rotating shaft 61. When motor 62 is energized, rotating shaft 61 and actuating cam 64 are rotated. Actuating cam 64 has a width shorter than the distance between a pair of bellows 54 and a length longer than the distance therebetween. When actuating cam 64 is in a horizontal position (illustrated as a solid line in FIG. 3), a pair of bellows 54 have its original shape. When actuating cam 64 is in a vertical position (illustrated as a dotted line in FIG. 3), a pair of bellows 54 are deformed by actuating cam 64 (contraction state). Because a pair of bellows 64 are made of elastic materials, they are restored to their original shape prior to their deformation when actuating cam 64 turns back in the horizontal position (inflation state).

Spaces 66 are formed within body 42 adjacent to outlets 44. Passages 46 and outlets 44 are communicated with spaces 66, respectively. Air compressed by a pair of bellows 64 is directed into spaces 66 through passages 46 to be expanded within spaces 66. Expanded air flows out through outlets 44.

Hereinafter, the operation of the bubble generator according to the invention will be described.

When motor 62 is energized, actuating cam 64 mounted to the outer end of rotating shaft 61 of motor 62 is rotated. By the rotation of actuating cam 64, a pair of bellows 54 is inflated and contracted in turn. When a pair of bellows 54 is inflated, air flows into a pair of bellows 54, passing through inlets 43 and holes 50. Because blocking elements 52 are made of elastic materials, they are deformed by inflow of air to open holes 50, while they are restored to their original shape to close holes 50 if the inflow of air ceases. When a pair of bellows 54 are contracted, air within a pair of bellows 54 is subjected to compression to be directed to passages 46 through holes 51. Air flowing into passages 46 is expanded in spaces 66 and flows out through outlets 44, so that air bubbles are supplied into a washing tub of an air bubble washing machine.

While the present invention has been particularly shown and described with reference to particular embodiment thereof, it will be understood by those skilled in the art that various changes in form and details may be effected therein without departing from the spirit and scope of the invention as defined by the appended claims.

What is claimed is:

1. A bubble generator for a washing machine comprising:

a housing;

a body including an inner wall and an outer wall, having inlets for inflow of air at one side thereof and outlets for outflow of air at the other side thereof, having passages for communicating said inlets with said outlets, said passages being defined by said inner and outer walls, having partitions for closing said passages, said partitions being formed adjacent to said inlets on the way of said passages, having spaces for expanding compressed air, said spaces being formed adjacent to said outlets, and having opposite pairs of holes formed at said inner wall, each pair of holes thereof being positioned so that portion of said inner wall at which one of said partitions is provided intervenes therebetween, said body being installed within said housing to expose said outlets out of said housing;

a pair of bellows provided opposite to each other on said inner wall of said body;

an actuating cam for vibrating the pair of bellows by rotation provided between the pair of bellows, said actuating cam having a width shorter than a distance between the pair of bellows and a length longer than the distance therebetween;

driving means for rotating said actuating cam;

elastic blocking means for intermittently closing a hole of each pair of holes provided adjacent to said inlets in response to pressure change within said passages, wherein said elastic blocking means is deformed to open said hole closed by said elastic blocking means if the pair of bellows are inflated, while said elastic blocking means is restored to their original shape to close said hole if the pair of bellows are contracted; and each of the pair of bellows is airtightly attached on said inner wall to surround each pair of holes and said blocking means.

2. The bubble generator as claimed in claim 1, wherein each of the pair of bellows is fixedly mounted on said inner wall by engaging an outer peripheral edge portion of each of the pair of bellows with a first protrusion formed on said inner wall.

3. The bubble generator as claimed in claim 1, wherein the pair of bellows have a circular shape.

4. The bubble generator as claimed in claim 1, wherein said driving means is a motor with a rotating shaft at an end of which said actuating cam is fixedly mounted.

5. The bubble generator as claimed in claim 1, wherein said elastic blocking means includes an elastic plate and a fixed portion for fixedly mounting said elastic plate on said inner wall.

6. The bubble generator as claimed in claim 5, wherein each of said elastic blocking means is fixedly mounted on said inner wall by engaging said fixed portion with a second protrusion formed on said inner wall.

7. The bubble generator as claimed in claim 1, wherein the pair of bellows and said elastic blocking means are made of rubber.

8. A bubble generator for a washing machine comprising:

a housing;

a body including an inner wall and an outer wall, having inlets for inflow of air at one side thereof and outlets for outflow of air at the other side thereof, having passages for communicating said inlets with said outlets, said passages being defined by said inner and outer walls, having partitions for closing said passages, said partitions being formed adjacent to said inlets on the way of said passages, having spaces for expanding compressed air, said spaces being formed adjacent to said outlets, and having opposite pairs of holes formed at said inner wall, each pair of holes thereof being positioned so that portion of said inner wall at which one of said partitions is provided intervenes therebetween, said body being installed within said housing to expose said outlets out of said housing;

a pair of bellows provided opposite to each other on said inner wall of said body;

an actuating cam for vibrating the pair of bellows by rotation provided between the pair of bellows, said actuating cam having a width shorter than a distance between the pair of bellows and a length longer than the distance therebetween;

driving means for rotating said actuating cam; and elastic blocking means for intermittently closing a hole of each pair of holes provided adjacent to said inlets in response to pressure change within said passages, wherein said elastic blocking means is deformed to open said hole closed by said elastic blocking means if the pair of bellows are inflated, while said elastic blocking means is restored to their original shape to close said hole if the pair of bellows are contracted;

each of the pair of bellows is airtightly attached on said inner wall to surround each pair of holes and said blocking means;

each of the pair of bellows is fixedly mounted on said inner wall by engaging an outer peripheral edge portion of each of the pair of bellows with a first protrusion formed on said inner wall;

the pair of bellows have a circular shape;

said driving means is a motor with a rotating shaft at an end of which said actuating cam is fixedly mounted;

said elastic blocking means includes an elastic plate and a fixed portion for fixedly mounting said elastic plate on said inner wall;

each of said elastic blocking means is fixedly mounted on said inner wall by engaging said fixed portion with a second protrusion formed on said inner wall; and the pair of bellows and said elastic blocking means are made of rubber.

* * * * *